US005711361A

United States Patent [19]

Landua et al.

[11] Patent Number: 5,711,361

[45] Date of Patent: Jan. 27, 1998

[54] METHOD FOR PRODUCING READY-TO-USE CASTING SHELLS OR CORE ASSEMBLIES

[75] Inventors: Werner Landua, Mannheim; Werner Pichler, Brühl, both of Germany

[73] Assignee: Adolf Hottinger Maschinenbau GmbH, Mannheim, Germany

[21] Appl. No.: 652,498

[22] PCT Filed: Dec. 1, 1994

[86] PCT No.: PCT/DE94/01421

§ 371 Date: Jun. 3, 1996

§ 102(e) Date: Jun. 3, 1996

[87] PCT Pub. No.: WO95/15231

PCT Pub. Date: Jun. 8, 1995

[30] Foreign Application Priority Data

Dec. 3, 1993 [DE] Germany ..... 43 41 123.3

[51] Int. Cl.[6] ..... B22C 9/10; B22C 13/08

[52] U.S. Cl. ..... 164/21; 164/20; 164/28; 164/186; 164/200

[58] Field of Search ..... 164/186, 200, 164/201, 202, 213, 29, 19, 20, 21, 22, 28

[56] References Cited

U.S. PATENT DOCUMENTS

| | | | |
|---|---|---|---|
| 4,100,961 | 7/1978 | Goss et al. | 164/213 X |
| 4,711,292 | 12/1987 | Rommel et al. | 164/200 |
| 4,757,855 | 7/1988 | Nagarwalla et al. | 164/200 X |
| 4,832,108 | 5/1989 | Nagarwalla et al. | 164/200 X |
| 5,014,766 | 5/1991 | Weber | 164/201 X |
| 5,072,775 | 12/1991 | Hale et al. | 164/186 |
| 5,242,008 | 9/1993 | Rommel et al. | 164/186 X |

FOREIGN PATENT DOCUMENTS

| | | | |
|---|---|---|---|
| 23 04 564 | 8/1974 | Germany . | |
| 3405420 | 5/1985 | Germany | 164/201 |
| 43 18 259 | 2/1994 | Germany . | |
| 43 34 857 | 10/1994 | Germany . | |

*Primary Examiner*—J. Reed Batten, Jr.

*Attorney, Agent, or Firm*—Bell Seltzer Intellectual Property Law Group of Alston & Bird LLP

[57] ABSTRACT

Ready-to-pour shells or core assemblies produced utilizing at least two in-line core shooting machines (1), each core shooting machine (1) having two, at least slightly differing sets of tools (4), each set comprising an upper tool (2) and a lower tool (3), and identical conveyor plates (5) serving, on the one hand, as the lower tool (3) of the first core shooting machine (1) and, on the other hand, as for transporting the core (6) or the core assembly along a transfer path (7) through the apparatus. For purposes of reducing floor space requirements with the use of a simple construction, the apparatus is designed and constructed such that, on the first core shooting machine (1), the operative tools (2, 3) of a first set of tools (4) are exchanged for tools (2, 3) of a second set of tools (4), after the conveyor plate (5) with the first core (6) thereon has left the first core shooting station, that on the second core shooting machine, the operative tools (2, 3) of the first set of tools (4) are exchanged for the tools (2, 3) of the second set of tools (4), after the conveyor plate (5) with the first and the second core (6) thereon has left the second core shooting station, and so on, until the exchange of the tools (2, 3) of the set of tools (4) to be substituted in the last core shooting station, so that a conveyor plate (5) accommodates cores (6) made exclusively with the same set of tools (4).

3 Claims, 1 Drawing Sheet

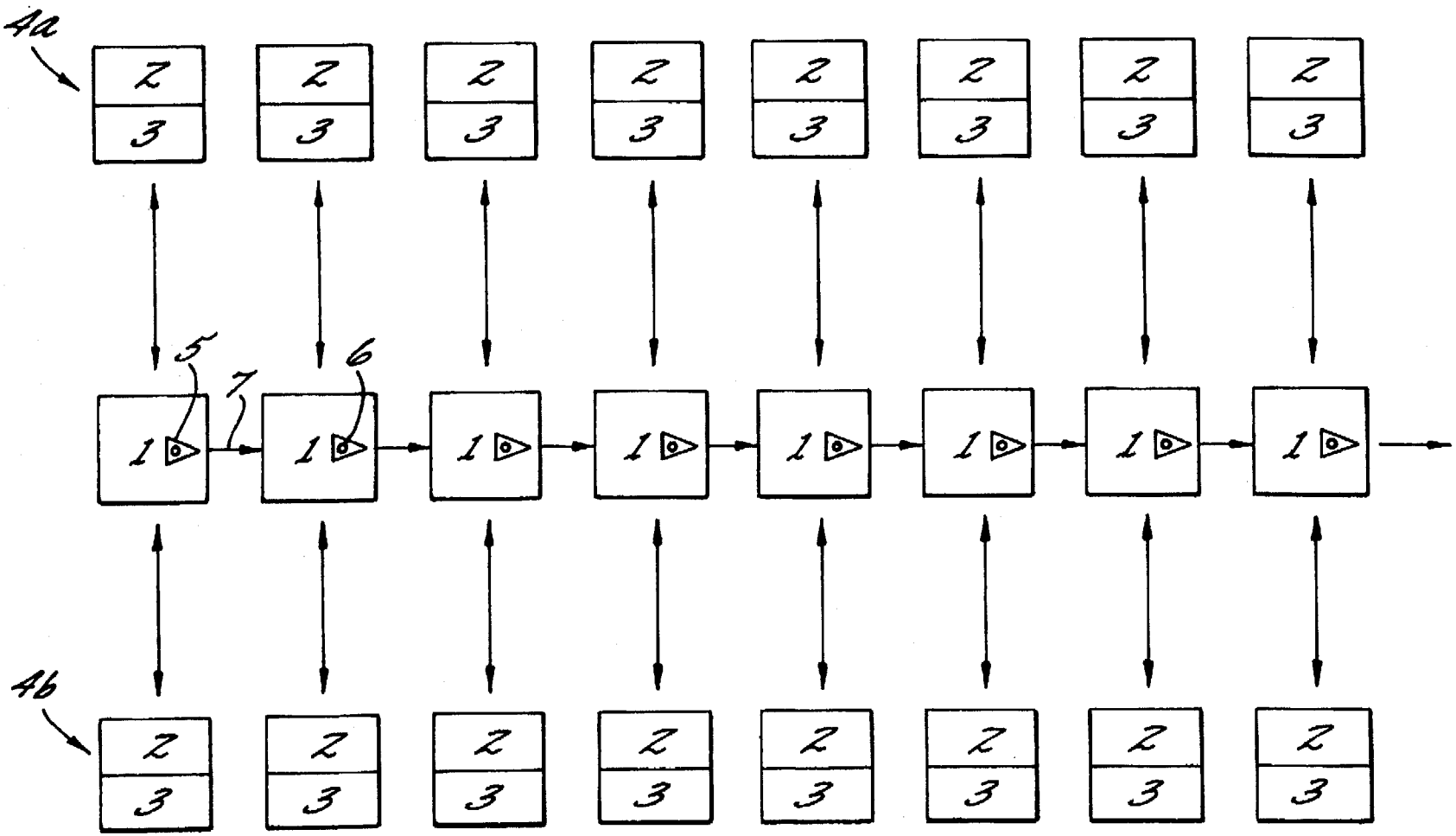
1
2
3
5
6
7
4a
4b

METHOD FOR PRODUCING READY-TO-USE CASTING SHELLS OR CORE ASSEMBLIES

The invention relates to an apparatus for making ready-to-pour shells or core assemblies, the apparatus comprising at least two in-line core shooting machines or shooting stations, the core shooting machines being provided with two, slightly differing sets of molds or tools, each set consisting of an upper tool and a lower tool, and with identical transfer components or conveyor plates that serve on the one hand as the lower tool of the first core shooting machine and on the other hand for transporting the core or core assembly along a transfer path through the apparatus. Furthermore, the invention relates to a method of making ready-to-pour shells or core assemblies with an apparatus of the present invention.

Basically, the present invention relates to the field of foundry practice. To produce castings, foundry cores or foundry molds are generally made as separate parts, combined and joined together to form a casting mold or core assembly. Thereafter, these core assemblies are filled with molten metal for producing, for example, a metallic workpiece. In mass production, the core assemblies filled with molten metal pass one after the other through the production line.

Apparatus for making core assemblies of the kind under discussion are known already from numerous publications. Only byway of example, reference is made in this connection to DE-OS 23 04 564. Further known from practice is to make the cores that are to be joined to a core assembly in a production line comprising several core shooting machines or shooting stations, a further core being added to the core assembly at each shooting station. To this end, the cores are deposited on a conveyor plate passing through the individual shooting stations, this conveyor plate serving simultaneously as the lower tool of the first shooting station.

The core sands used to make the core assemblies are always mixed with binding agents, which cause considerable soiling of the tools, namely the upper tool and the lower tool. As a result, it is necessary to clean the tools after a certain number of operating cycles and to exchange them at the shooting stations for this purpose. However, in practice such a tool change is extremely problematic, since the tools of the individual shooting stations and, thus, the cores produced therein are exactly adapted to one another. In other words, the contours of the cores being stacked upon their production by one set of tools are adapted to one another, so as to rest against each other. The slightest deviations In contours of adjoining surfaces of the cores being stacked would cause considerable tensions to occur during the stacking, so that it is very likely that the cores would break.

When in the known apparatus a set of tools is exchanged because of soiling, it will be necessary to remove altogether the conveyor plates being in the line with the already finished cores thereon as rejects, since for the aforesaid reasons, it is no longer possible to further add to the previously produced cores the cores that are produced by the exchanged tool set, due to slightest deviations in the contours of the tool surfaces and, thus, also in the surfaces of the cores produced therewith. In other words, in the known apparatus, it will always be necessary to restart the entire production line after completion of a tool change, and to remove or separate cores being in the production line. Apart from the waste of material caused by the rejects, this will involve a considerable loss of time and, thus, reduce the capacity of the production quite significantly, which again will substantially increase the costs of each core assembly.

German Patent No. 43 18 259 addresses the foregoing problem, and it discloses a method and apparatus wherein the tools of a first set are exchanged jointly, i.e. at the same time, at all shooting stations for the tools of a second set. The alternative arrangement to the teaching claimed therein is designed and constructed such that at least one parking station for the conveyor plate with the cores loaded thereon is associated to each core shooting machine, and that the parking station serves to accommodate a conveyor plate that is removed from the transfer path during a first tool change and returned to the transfer path during a second tool change, so that there are on the transfer path conveyor plates carrying exclusively cores or core assemblies produced with the tool set in use, and that the parking stations accommodate conveyor plates carrying exclusively cores or core assemblies produced with the inoperative set of tools. In accordance with this alternative configuration, it has been recognized already that with the use of two sets of tools in each core shooting machine, it will not be useful, from the viewpoint of the manufacturing costs, to exactly "match" or adapt both tool sets to one another, so that practically no manufacturing tolerances occur between the cores produced with the different tool sets in the respective shooting stations. Instead, it will, in essence, be more useful to continue after a tool change the production with cores that have been produced previously with the substituted set of tools.

To this end, a parking station for the conveyor plate is associated to each core shooting machine of the alternative arrangement, so that during a first change of tools—change to the second set of tools—the cores or core assembly being at that time in the respective shooting stations are moved into the parking station instead of being removed. Only during a first change of tools, is it necessary to restart the production line in an emptied state. However, when a previously exchanged and cleaned set of tools is reinserted, the cores or conveyor plates with the cores thereon will be moved into the parking station, and the cores parked therein, which have previously been produced with the cleaned and now reinserted tool set, can be returned to the transfer path. Consequently, there are on the transfer path cores or conveyor plates carrying core assemblies made exclusively with the set of tools in use, and the parking stations accommodate cores or conveyor plates carrying core assemblies that were made exclusively with the set of inoperative tools. The expedient of exchanging cores or core assemblies respectively made with the corresponding set of tools does not necessitate a new startup of the production line after a change of the tool set. Instead, the production may be continued with the reinserted tool set precisely at the point, where it has been interrupted for the purpose of a change. Consequently, in the alternative apparatus, production is interrupted only until the change of the tool sets, on the one hand, and of the conveyor plates on the other, is completed.

Likewise, the above-described alternative apparatus is, however, problematic in practice since, on the one hand, the arrangement of the parking stations is expensive with respect to construction and, on the other hand, it requires a very large floor space.

It is therefore the object of the present invention to describe both an apparatus of the initially described type and a corresponding method, wherein rejected cores caused by the tool change and startup times for "filling" the production line are effectively avoided by a simplest construction and with the least floor space requirements.

The above and other objects and advantages are achieved by the method of the present invention, and wherein in a first core shooting machine, the tools of a first tool set in use can be exchanged for the tools of a second set, namely after the conveyor plate with the first core thereon has left the first core shooting station; and that, in a second core shooting machine, the operative tools of the first tool set are exchangeable for the tools of the second set of tools, after the conveyor plate with the first and the second core has left the second core shooting station, etc., until the last set of tools is exchanged in the last core shooting station, so that cores exclusively produced with the same set of tools are loaded on a conveyor plate.

In accordance with the invention, it has been recognized that the problems concerning the exchange of tool sets can be solved without providing parking stations for removing conveyor plates with the cores loaded thereon, namely, in that the tools being used in the different core shooting stations are not exchanged at the same time, but with a delay in time or out of sync. As a result, a conveyor plate carrying a first core will pass, in accordance with the invention, through all core shooting stations, so as to be completed to a core assembly. After having passed through a particular core shooting station, the respective tool or set of tools is exchanged, so that the subsequent conveyor plate carries only cores which have been made previously with the reinserted set of tools. Thus, a removal of conveyor plates with cores loaded thereon becomes unnecessary, so that special parking stations for the conveyor plates loaded with cores are not needed. Instead, a conveyor plate carrying a first core, is loaded or completed at each core shooting station with further cores, which are made with the tools of the same set. In each core shooting station, the tool of the one set to be changed is exchanged for a tool of the other set only when the core required for the assembly of cores has been produced and stacked on the conveyor plate or on the other cores. In any event, it is essential that it is not necessary to either remove conveyor plates or provide so-called parking stations.

Within the scope of an advantageous configuration, the transfer path linearly extending through the shooting stations, is formed by rollers carrying the conveyor plates. The rollers may engage laterally below the conveyor plates or corresponding projections thereof. With respect to detailed constructional configurations, reference is expressly made to German Patent No. P 43 18 259, the disclosure of which is herewith explicitly incorporated by reference.

As regards a specific core shooting production line, same could include, for example eight core shooting machines or shooting stations with tool sets and conveyor plates associated thereto.

The method of the present invention comprises the production of ready-to-pour shells or core assemblies, wherein a first core is shot in a first core shooting station, and transported on a conveyor plate serving as the bottom tool of the first core shooting machine to a subsequent shooting station. In a second core shooting station, a second core is shot, the lower tool of the second shooting station is lowered, the conveyor plate with the first core thereon is moved below the upper tool of the second shooting station, and the second core is deposited on the first core being on the conveyor plate, etc. In accordance with the invention, the following method steps are provided:

The operative tools of a first tool set are exchanged on the first core shooting machine for the tools of a second set of tools, after the conveyor plate with the first core thereon has left the first core shooting station. Subsequently, the operative tools of the first tool set are exchanged on the second core shooting machine for the tools of the second tool set, after the conveyor plate with the first and the second core thereon has left the second core shooting station. This process repeats itself in accordance with the number of all provided core shooting machines, until the last set of tools has been changed in the last core shooting station, so that a conveyor plate accommodates exclusively cores, which have been made with the tools of the same set.

There exist various possibilities of improving and further developing the teaching of the present invention in advantageous manner. To this end, reference may be made to the following, short description of an embodiment of the invention with reference to the drawing. In conjunction with the description of the preferred embodiment of the invention with reference to the drawing, also generally preferred embodiments and further developments of the teaching are described. In the drawing, the only figure is a schematic block diagram of an apparatus in accordance with the invention with a total of eight core shooting machines or core shooting stations and two complete tool sets.

Shown in the only FIGURE is a linearly arranged core shooting production line comprising a total of eight core shooting machines or shooting stations 1. Each core shooting machine 1 is provided with two, at least slightly differing tool sets 4*a* and 4*b*, each set consisting of an upper tool 2 and a lower tool 3. Identical conveyor plates 5 serve, on the one hand, as the lower tool 2 of the first core shooting machine 1 and, on the other hand, for transporting a core 6 or a core assembly along a transfer path 7 through the arrangement.

In accordance with the invention, on the first core shooting machine 1, the operative tools 2, 3 of a first set of tools 4*a* are exchanged for the tools 2, 3 of second set of tools 4*b*, after conveyor plate 5 with the first core 6 thereon has left the first core shooting station. Subsequently, the operative tools 2, 3 of the first set of tools 4*a* are exchanged on the second core shooting machine 1 for the tools 2, 3 of the second tool set 4*b*, likewise after the conveyor plate 5 with the first and the second core 6 has left the second core shooting station. This process repeats itself to the last core shooting station, namely until the tools 2, 3 of the set of tools 4 to be changed are exchanged on the last core shooting station, so that a conveyor plate 5 accommodates cores 6 that are made exclusively with the same set of tools 4.

With respect to carrying out the method of the present invention, the general part of the specification is herewith incorporated by reference, for purposes of avoiding repetitions.

Finally, it should be noted that the foregoing embodiment describes the teaching of the present invention merely by way of example, without however limiting same thereto.

We claim:

1. A method of producing ready to pour multi-part core assemblies adapted for use as a foundry mold and comprising the steps of (a) providing an apparatus for making such core assemblies which includes at least two core shooting machines (1) disposed along a production line (7), at least two sets of tools (4*a* and 4*b*) operatively associated with each core shooting machine, with each set of tools for each shooting machine comprising an upper tool (2) and a lower tool (3), (b) shooting in one of the two sets of tools (4*a*) of a first core shooting machine a first core (6), and moving the first core on a conveyor plate (5) which served as the lower tool (3) of the one set of tools to a second shooting machine, (c) shooting in one of the two sets of tools (4*a*) of a second core shooting machine a second core (6), lowering the lower tool (3) of the one set of tools of the second core shooting machine, moving the conveyor plate (5) with the first core (6) thereon below the upper tool (2) of the second shooting station, and depositing the second core (6) on the first core (6) carried on the conveyor plate (5), (d) exchanging on the first core shooting machine the other of the two sets of tools (4*b*) for the one set of tools (4*a*) after the conveyor plate (5) with the first core (6) thereon has left the first core shooting station, and (e) exchanging on the second core shooting machine the other of the two sets of tools (4*b*) for the one set of tools (4*a*) after the conveyor plate (5) with the first and second cores thereon has left the second core shooting station, whereby both of the cores deposited on the conveyor plate (5) are made with the tools of the one set (4*a*) and both of the cores deposited on a subsequent conveyor plate are made with the tools of the other set (4*b*).

2. The method as defined in claim 1 wherein the apparatus includes more than two of said core shooting machines (1), and comprising the further step of repeating steps (c) and (e) at each of the remaining core shooting machines, so that all of the cores deposited on the conveyor plate (5) are made with the tools of the one set (4*a*) and all of the cores deposited on a subsequent conveyor plate are made with the tools of the other set (4*b*).

3. The method as defined in claim 2 wherein all of the core shooting machines are disposed along a linear production line.

* * * * *